US011227535B2

(12) United States Patent
Zhang

(10) Patent No.: US 11,227,535 B2
(45) Date of Patent: Jan. 18, 2022

(54) GATE ON ARRAY UNIT, GOA CIRCUIT AND DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventor: Liuqi Zhang, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 245 days.

(21) Appl. No.: 16/617,666

(22) PCT Filed: Sep. 20, 2019

(86) PCT No.: PCT/CN2019/106843
§ 371 (c)(1),
(2) Date: Nov. 27, 2019

(87) PCT Pub. No.: WO2021/012373
PCT Pub. Date: Jan. 28, 2021

(65) Prior Publication Data

US 2021/0335217 A1 Oct. 28, 2021

(30) Foreign Application Priority Data

Jul. 23, 2019 (CN) ..... 201910667553.5

(51) Int. Cl.
*G09G 3/32* (2016.01)

(52) U.S. Cl.
CPC ..... *G09G 3/32* (2013.01); *G09G 2310/08* (2013.01)

(58) Field of Classification Search
None
See application file for complete search history.

(56) References Cited

U.S. PATENT DOCUMENTS

2008/0048712 A1* 2/2008 Ahn ..... H03K 17/161 326/21
2016/0253950 A1* 9/2016 Ma ..... G11C 19/184 345/100
2020/0357341 A1* 11/2020 Xue ..... G09G 3/3266

* cited by examiner

*Primary Examiner* — Dorothy Harris
(74) *Attorney, Agent, or Firm* — Osha Bergman Watanabe & Burton LLP

(57) ABSTRACT

A GOA unit, a GOA circuit and a display panel are provided. The GOA unit includes a pull-up module, a pull-up holding module, a converting module, a pull-down holding module, and a pull-down module. Each module can be implemented with N-type TFTs. The GOA unit could generate a negative impulse waveform for internal feedback mechanism.

20 Claims, 4 Drawing Sheets

GATE ON ARRAY UNIT, GOA CIRCUIT AND DISPLAY PANEL

FIELD OF THE INVENTION

The present invention relates to display techniques, and more particularly to a GOA circuit, GOA unit and display panel capable of generating negative impulse clocks for internal feedback.

BACKGROUND OF THE INVENTION

As the development of the display panels, a larger screen, a higher definition and a more exciting visual effect are required. This increases the demands for a better display manufacturing process, materials and techniques. Organic light emitting diode (OLED) display panel is a type of self-luminous display technique and it has advantages of huge view angle, high contrast, low power consumption, and bright color. Because of these advantages, the AMOLED (active matrix organic light emitting diode) display panel plays a more important role in the display business. Thin film transistor (TFT) has advantages of high space usage efficiency, low power consumption, no radiation, and low electro-magnetic interference. Gate driver on array (GOA) technique is a technique, which uses the current TFT array substrate manufacturing process to form the gate drivers on the array substrate.

Because the GOA circuit replaces the external chip, it reduces the manufacturing process steps of the display device and thus reduces the costs. Further, it could reduce the number of gate IC and raises the integration of the display device. IGZO (indium gallium zinc oxide) is used as a new generation of channel layer material in TFT technique. Because the IGZO has a high mobility and high uniformity, it has been widely used in big size AMOLED display panel. However, because it has a low stability, a feedback circuit is often used to ensure the uniformity of brightness of the AMOLED display penal.

Please refer to FIGS. 1A-1B. FIG. 1A is a diagram of a conventional 5T2C feedback circuit. FIG. 1B is a diagram showing waveforms of signals shown in FIG. 1A.

As shown in FIG. 1, the feedback circuit comprises a first TFT T11, a second TFT T12, a third TFT T13, a fourth TFT T14, a fifth TFT T15, a first capacitor C11 and a second capacitor C12. The gate of the first TFT T11 is coupled to the first emitting control signal EM1. The first end of the first TFT T11 is coupled to the gate of the second TFT T12. The second end of the first TFT T11 is coupled to the first voltage source VDD. The gate of the second TFT T12 is coupled to the first end of the fifth TFT T15. The second end of the second TFT T12 is coupled to the first end of the third TFT T13 and the second end of the fourth TFT T14. The gate of the third TFT T13 is coupled to the second emitting control signal EM2. The second end of the third TFT T13 is coupled to the anode of a light emitting diode OLED1. The cathode of the light emitting diode OLED1 is coupled to the second voltage source VSS. The gate of the fourth TFT T14 is coupled to a data reading control signal RD. The first end of the fourth TFT T14 is coupled to a sensing signal Sensing. The gate of the fifth TFT T15 is coupled to a data writing control signal WR. The second end of the fifth TFT T15 is coupled to the data signal Data. The first capacitor C11 is coupled between the gate and the second end of the second TFT T12. The second capacitor C12 is coupled between the second end of the first TFT T11 and the second end of the second TFT T12.

As shown in FIG. 1B, two waveforms need to be provided to the feedback circuit in order to achieve the internal feedback mechanism of the AMOLED display panel. One is a positive impulse waveform (WR/RD), which can be generated using the GOA circuit of a regular IGZO_TFT. The other one is a negative impulse waveform (EM1/EM2), which requires a p-type GOA circuit to generate. However, p-type GOA circuit is not normal in this field.

Therefore, a solution that utilizes a normal circuit to generate the above-mentioned negative impulse waveform for internal feedback mechanism is required.

SUMMARY OF THE INVENTION

One objective of an embodiment of the present invention is to provide a GOA unit, a GOA circuit and a display panel, which could utilize a normal circuit to generate a negative impulse waveform for internal feedback mechanism.

According to an embodiment of the present invention, a GOA circuit is provided. The GOA circuit comprises a plurality of GOA units connected in series. The GOA unit comprises: a pull-up module, coupled to a clock signal end, a control signal end, and a first node, configured to output the signal of the control signal end to the first node under a control of a first voltage level of the clock signal end; a pull-up holding module, coupled to a first voltage end, a first output end, a second output end, and the first node, configured to output a signal of the first voltage end to the first output end and the second output end under a control of the first node; a converting module, coupled to a second voltage end, a second node, the first voltage end and the first node, configured to output a signal of the second voltage end or a signal of the first voltage end to the second node; a pull-down holding module, coupled to the second voltage end, the second node, and the first node, configured to output the signal of the second voltage end to the first node under a control of the second node; and a pull-down module, coupled to the clock signal end, the second node, the first output end and the second output end, configured to output a second voltage level of the clock signal end to the first output end and the second output end.

According to another embodiment of the present invention, a GOA circuit is provided. The GOA circuit comprises a plurality of GOA units connected in series. The GOA unit comprises: a pull-up module, coupled to a clock signal end, a control signal end, and a first node, configured to output the signal of the control signal end to the first node under a control of a first voltage level of the clock signal end; a pull-up holding module, coupled to a first voltage end, a first output end, a second output end, and the first node, configured to output a signal of the first voltage end to the first output end and the second output end under a control of the first node; a converting module, coupled to a second voltage end, a second node, the first voltage end and the first node, configured to output a signal of the second voltage end or a signal of the first voltage end to the second node; a pull-down holding module, coupled to the second voltage end, the second node, and the first node, configured to output the signal of the second voltage end to the first node under a control of the second node; and a pull-down module, coupled to the clock signal end, the second node, the first output end and the second output end, configured to output a second voltage level of the clock signal end to the first output end and the second output end. In the embodiment, except for a first PIA unit, in two adjacent GOA units, the control signal end of a succeeding GOA unit is coupled to the second output end of a previous GOA unit, and the control signal end of the first GOA unit is coupled to a control signal source. In all the GOA units, the clock signal end of each of odd GOA units is coupled to a first clock signal source, the clock signal end of each of even GOA units is coupled to a second clock signal source, and a signal of the first clock signal source and a signal of the second clock signal have opposite phases. The first voltage end of each of all the GOA units is coupled to a first voltage source and the second voltage end of each of all the GOA units is coupled to a second voltage source.

According to still another embodiment of the present invention, a display panel is provided. The display panel comprises a GOA circuit is provided. The GOA circuit comprises a plurality of GOA units connected in series. The GOA unit comprises: a pull-up module, coupled to a clock signal end, a control signal end, and a first node, configured to output the signal of the control signal end to the first node under a control of a first voltage level of the clock signal end; a pull-up holding module, coupled to a first voltage end, a first output end, a second output end, and the first node, configured to output a signal of the first voltage end to the first output end and the second output end under a control of the first node; a converting module, coupled to a second voltage end, a second node, the first voltage end and the first node, configured to output a signal of the second voltage end or a signal of the first voltage end to the second node; a pull-down holding module, coupled to the second voltage end, the second node, and the first node, configured to output the signal of the second voltage end to the first node under a control of the second node; and a pull-down module, coupled to the clock signal end, the second node, the first output end and the second output end, configured to output a second voltage level of the clock signal end to the first output end and the second output end. In the embodiment, except for a first PIA unit, in two adjacent GOA units, the control signal end of a succeeding GOA unit is coupled to the second output end of a previous GOA unit, and the control signal end of the first GOA unit is coupled to a control signal source. In all the GOA units, the clock signal end of each of odd GOA units is coupled to a first clock signal source, the clock signal end of each of even GOA units is coupled to a second clock signal source, and a signal of the first clock signal source and a signal of the second clock signal have opposite phases. The first voltage end of each of all the GOA units is coupled to a first voltage source and the second voltage end of each of all the GOA units is coupled to a second voltage source.

The GOA circuit could provide the negative impulse waveform to the feedback circuit of the display panel. Further, the GOA unit can be implemented with N-type TFT, which is normally used. This makes it more easily to implement.

BRIEF DESCRIPTION OF THE DRAWINGS

The accompanying drawings described herein are used to provide further comprehension of the present disclosure, and is a part of the present application. Schematic embodiments of the present disclosure and the description thereof are used to illustrate the present disclosure, but do not constitute any improper limit to the present disclosure. In the accompanying drawings.

DETAILED DESCRIPTION OF PREFERRED EMBODIMENTS

Figure 1A:
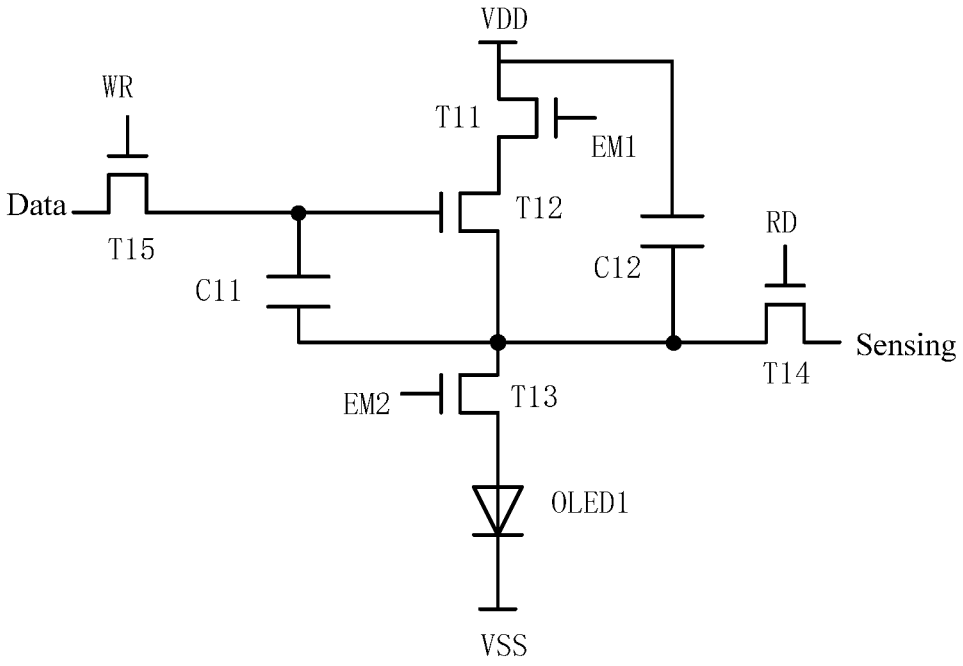
FIG. 1A is a diagram of a conventional 5T2C feedback circuit.
Figure 1B:
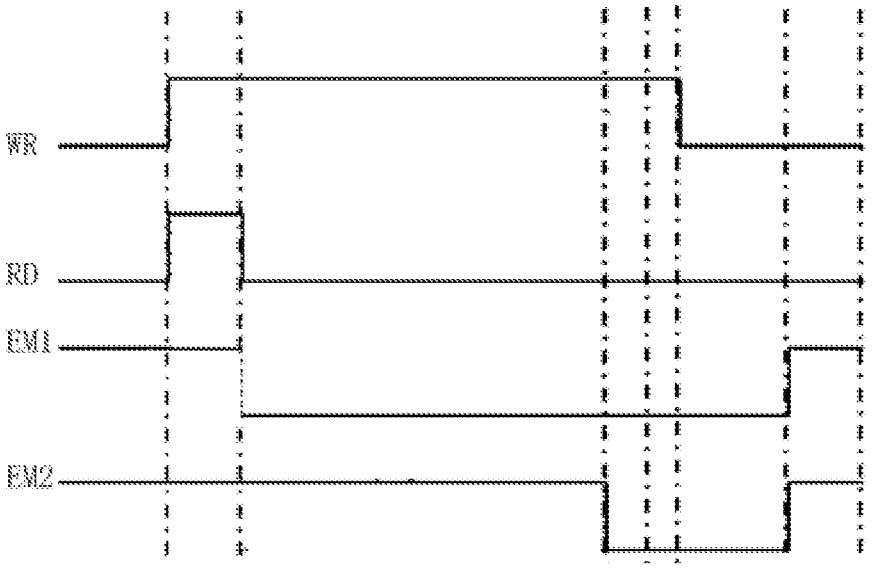
FIG. 1B is a diagram of waveforms of signals shown in FIG. 1A.

The invention is described below in detail with reference to the accompanying drawings, wherein like reference numerals are used to identify like elements illustrated in one or more of the figures thereof, and in which exemplary embodiments of the invention are shown. This invention may, however, be embodied in many different forms and should not be construed as limited to the particular embodiments set forth herein. Rather, these embodiments are provided so that this disclosure will be thorough and complete, and will fully convey the scope of the invention to those skilled in the art.

All of the terminologies containing one or more technical or scientific terminologies have the same meanings that persons skilled in the art understand ordinarily unless they are not defined otherwise. For example, "upper" or "lower" of a first characteristic and a second characteristic may include a direct touch between the first and second characteristics. The first and second characteristics are not directly touched; instead, the first and second characteristics are touched via other characteristics between the first and second characteristics. Besides, the first characteristic arranged on/above/over the second characteristic implies that the first characteristic arranged right above/obliquely above or merely means that the level of the first characteristic is higher than the level of the second characteristic. The first characteristic arranged under/below/beneath the second characteristic implies that the first characteristic arranged right under/obliquely under or merely means that the level of the first characteristic is lower than the level of the second characteristic.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 2:
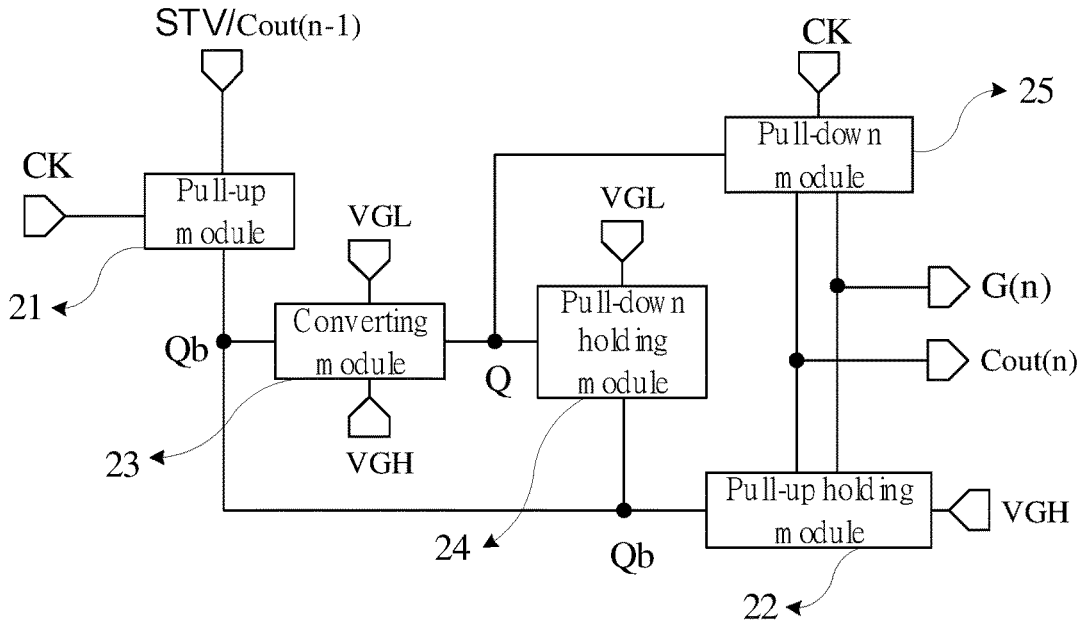
FIG. 2 is a block diagram of a GOA unit according to an embodiment of the present invention.

Please refer to FIG. 2, which is a block diagram of a GOA unit according to an embodiment of the present invention. The GOA unit 20 comprises a pull-up module 21, pull-up holding module 22, a converting module 23, a pull-down holding module 24 and a pull-down module 25.

The pull-up module 21 is coupled to the clock signal end CK, the control signal end Cout(n−1) and the first node Qb. The pull-up module 21 is used to output the signal of the control signal end Cout(n−1) to the first node Qb under the control of the first voltage signal of the clock signal end CK. The signal received by the control signal end Cout(n−1) could be a signal provided by a control signal source STV or a signal outputted from a second output end Cout(n−1) of a previous GOA unit in a series-connected GOA units. Here, the n is a integer larger than 1. The first voltage level of the clock signal end CK corresponds to a high voltage level (the voltage level is higher than a predetermined voltage level). For example, when the pull-up module 21 is turned on under the control of the high voltage signal of the clock signal end CK, if the control signal end Cout(n−1) corresponds to a high voltage level, the first node Qb signal corresponds to the high voltage level. When the pull-up module 21 is turned on under the control of the high voltage signal of the clock signal end CK, if the control signal end Cout(n−1) corresponds to a low voltage level, the first node Qb signal corresponds to the low voltage level.

The pull-up holding module 22 is coupled to the first voltage end VGH, the first output end G(n), the second output end Cout(n), and the first node Qb. The pull-up holding module 22 is used to output the signal of the first voltage end VGH to the first output end G(n) and the second output end Cout(n) under the control of the first node Qb. The first voltage end VGH provides a high voltage level signal (the voltage level is higher than a predetermined voltage level)). For example, when the pull-up holding module 22 is turned on under the control of the first node Qb, the high voltage level signal of the first voltage end VGH is transferred through pull-up holding module 22 to the first output end G(n) and the second output end Cout(n) such that the first output end G(n) and the second output end Cout(n) output the high voltage level signal. In this embodiment, the first output end G(n) and the second output end Cout(n) output the same signal. The signal outputted by the first output end G(n) is inputted into the display panel. The signal outputted by the second output end Cout(n) is inputted to the control signal end Cout(n+1) of a next GOA unit in the series-connected GOA units.

The converting module 23 is coupled to the second voltage end VGL, the second node Q, the first voltage end VGH and the first node Qb. The converting module 23 is used to output the signal of the first voltage end VGH or the second voltage end VGL to the second node Q under the control of the first node Qb. The second voltage end VGL provides a low voltage level signal (the voltage level is lower than a predetermined voltage level). For example, when the first node Qb corresponds to a low voltage level, the high voltage level signal of the first voltage end VGH is transferred to the second node Q through the converting module 23 such that the second node Q outputs the high voltage level signal. When the first node Qb corresponds to a high voltage level, the low voltage level signal of the second voltage end VGL is transferred to the second node Q through the converting module 23 such that the second node Q outputs the low voltage level signal.

The pull-down module 25 is coupled to the clock signal end CK, the second node Q, the first output end G(n), and the second output end Cout(n). The pull-down module 25 is used to output the second voltage level signal of the clock signal end CK to the first output end G(n) and the second output end Cout(n) under the control of the second node Q. The second voltage level signal of the clock signal end CK is a low voltage level signal (the voltage level is lower than a predetermined voltage level). For example, when the clock signal end CL outputs a low voltage level signal, the first node Qb corresponds to a low voltage level. When the second node Q corresponds to a high voltage level, the low voltage level signal of the clock signal end CK is transferred to the first output end G(n) and the second output end Cout(n) through the pull-down module 25 to pull down their voltage levels such that the first output end G(n) provides a negative impulse waveform to the inner feedback circuit of the display panel. Here, the signal of the first node Qb and the signal of the second node Q have opposite phases.

Preferably, the above-mentioned GOA unit could be implemented with N-type TFTs. Therefore, it could be implemented with a normal structure or a normal circuit implementation to provide the negative impulse waveform to the inner feedback circuit of the display panel.

Figure 3:
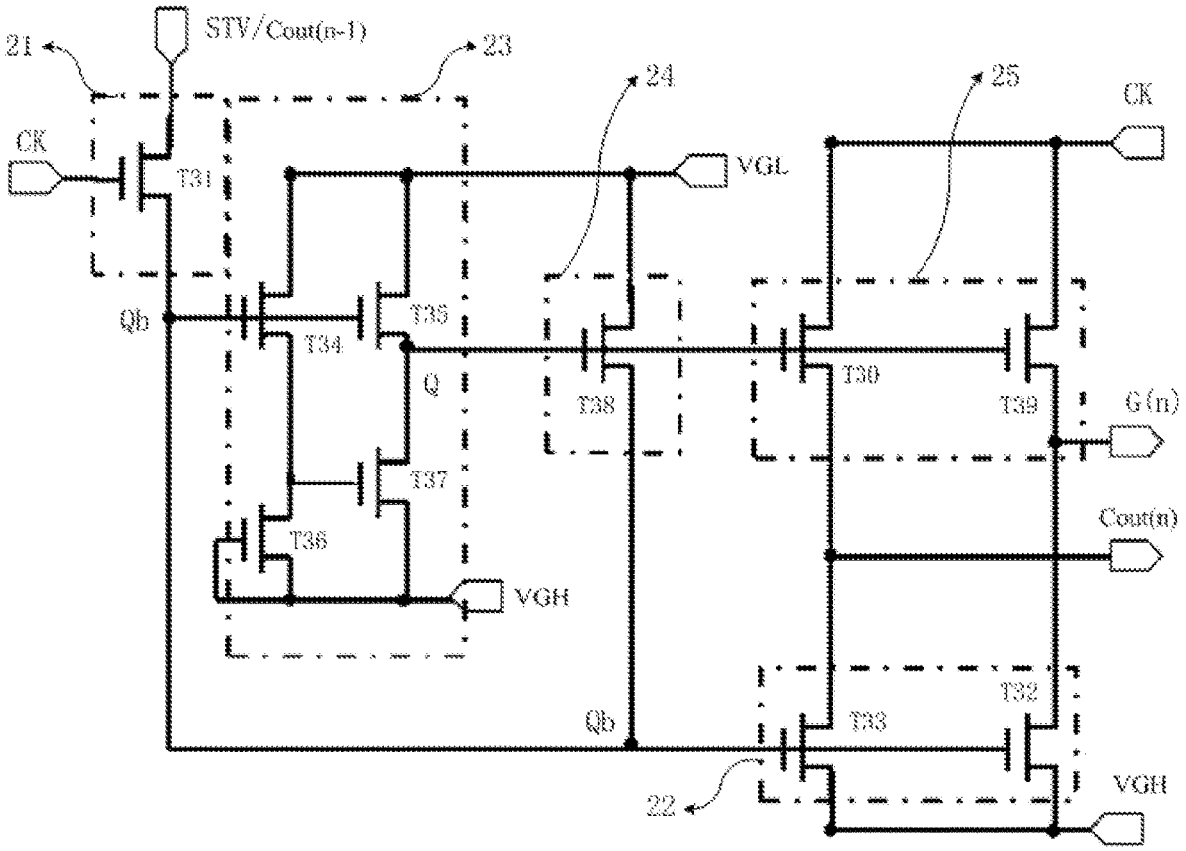
FIG. 3 is a diagram of a circuit of a GOA unit according to an embodiment of the present invention.

Please refer to FIG. 3, which is a diagram of a circuit of a GOA unit according to an embodiment of the present invention.

The pull-up module 21 comprises the first transistor T31. The gate of the first transistor T31 is coupled to the clock signal end CK. The first end of the first transistor T31 is coupled to the control signal end Cout(n−1). The second end of the first transistor T31 is coupled to the first node Qb. When the clock signal end CK outputs a high voltage level signal, the first transistor T31 is turned on such that the signal of the control signal end Cout(n−1) is transferred to the first node Qb through the first transistor T31. If the signal of the control signal end Cout(n−1) corresponds to a high voltage level, then the first node Qb corresponds to the high voltage level. If the signal of the control signal end Cout (n−1) corresponds to a low voltage level, then the first node Qb corresponds to the low voltage level.

The pull-up holding module 22 comprises the second transistor T32 and the third transistor T33. The gate of the second transistor T32 is coupled to the first node Qb. The first end of the second transistor T32 is coupled to the first output end G(n). The second end of the second transistor T32 is coupled to the first voltage end VGH. The gate of the third transistor T33 is coupled to the first node Qb. The first end of the third transistor T33 is coupled to the second output end Cout(n). The second end of the third transistor T33 is coupled to the first voltage end VGH. The first voltage end VGH provides a DC high voltage level (the voltage level is higher than a predetermined voltage level). When the first node Qb outputs a high voltage level signal, the second transistor T32 and the third transistor T33 are both turned on, the DC high voltage level signal is transferred to the first output end G(n) through the second transistor T32 such that the first output end G(n) outputs the high voltage level signal. The DC high voltage level signal is at the same time transferred to the second output end Cout(n) through the third transistor T33 such that the second output end Cout(n) outputs the high voltage level signal. In another embodiment, the pull-up holding module 22 could be implemented with a single transistor. The gate of the single transistor is coupled to the first node Qb. The first end of the single transistor is coupled to both of the first output end G(n) and the second output end Cout(n). the second end of the single transistor is coupled to the first voltage end VGH. The single transistor is used to simultaneously output the signal of the first voltage end VGH to the first output end G(n) and the second output end Cout(n) under the control of the first node Qb.

The converting module 23 comprises the fourth transistor T34, the fifth transistor T35, the sixth transistor T36 and the seventh transistor T37. The gate of the fourth transistor T34 is coupled to the first node Qb. The first end of the fourth transistor T34 is coupled to the second voltage end VGL. The second end of the fourth transistor T34 is coupled to the first end of the sixth transistor T36 and the gate of the seventh transistor T37. The gate of the fifth transistor T35 is coupled to the first node Qb. The first end of the fifth transistor T35 is coupled to the second voltage end VGL.

The second end of the fifth transistor T35 is coupled to the second node Q. The gate and the second end of the sixth transistor T36 are both coupled to the first voltage end VGH. The second end of the seventh transistor T37 is coupled to the first voltage end VGH. The second voltage end VGL provides a DC low voltage level signal (the voltage level is lower than a predetermined voltage level). When the first node Qb outputs a low voltage level signal, when the fourth transistor T34 and the fifth transistor T35 are both turned off. The DC high voltage level signal pass through the sixth transistor T36 and the seventh transistor T37 pulls up the voltage level of the second node Q such that the second node Q outputs the high voltage level signal. When the first node Qb outputs a high voltage level signal, when the fourth transistor T34 and the fifth transistor T35 are both turned on. The DC low voltage level signal pass through the fourth transistor T34 and the fifth transistor T35 pulls down the voltage level of the second node Q such that the second node Q outputs the low voltage level signal.

The pull-down holding module 24 comprises an eighth transistor T38. The gate of the eighth transistor T38 is coupled to the second node Q. The first end of the eighth transistor T38 is coupled to the second node Q. The first end of the eighth transistor T38 is coupled to the second voltage end VGL. The second end of the eighth transistor T38 is coupled to the first node Qb. When the second node Q corresponds to a high voltage level, the eighth transistor T38 is turned on, the DC low voltage signal is transferred to the first node Qb through the eighth transistor T38 such that the first node Qb maintains a low voltage level.

The pull down module 25 comprises the ninth transistor T39 and the tenth transistor T30. The gate of the ninth transistor T39 is coupled to the second node Q. The first end of the ninth transistor T39 is coupled to the clock signal end CK. The second end of the ninth transistor T39 is coupled to the first output end G(n). The gate of the tenth transistor T30 is coupled to the second node Q. The first end of the tenth transistor T30 is coupled to the clock signal end CK. The second end of the tenth transistor T30 is coupled to the second output end Cout(n). When the clock signal end CK outputs a low voltage level signal, the first node Q maintains its low voltage level. At this time, if the second node Q corresponds to a high voltage level, the ninth transistor T39 and the tenth transistor T30 are both turned on and thus the low voltage level signal of the clock signal end CK passes through the ninth transistor T39 to the first output end G(n) to pull down its voltage level such that the first output end G(n) provides the negative impulse waveform to the feedback circuit of the display panel. Further, the low voltage level signal of the clock signal end CK passes through the tenth transistor T30 to the second output end Cout(n) to pull down its voltage level. in another embodiment, the pull-down module 25 could be implemented with a single transistor. The gate of the single transistor is coupled to the second node Q. The first end of the single transistor is coupled to the clock signal end CK. The second end of the single transistor is coupled to the first output end G(n) and the second output end Cout(n) such that the second voltage signal of the clock signal end CK could be outputted to the first output end G(n) and the second output end Cout(n) under the control of the second node Q.

Preferably, the above-mentioned first to tenth transistors could be implemented with N-type TFTs. In this way, when the above-mentioned GOA units are connected in series to form a GOA circuit. This GOA circuit could be implemented using normal devices and is capable of providing the negative impulse waveform to the feedback circuit of the display panel.

Figure 4A:
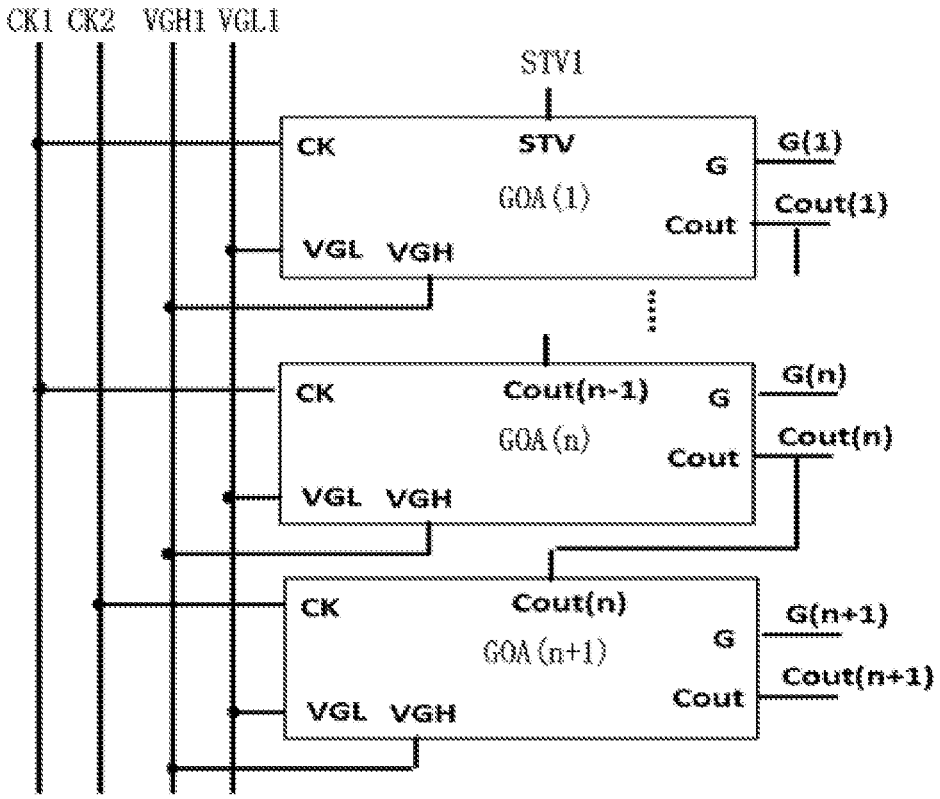
FIG. 4A is a diagram of a GOA circuit according to an embodiment of the present invention.
Figure 4B:
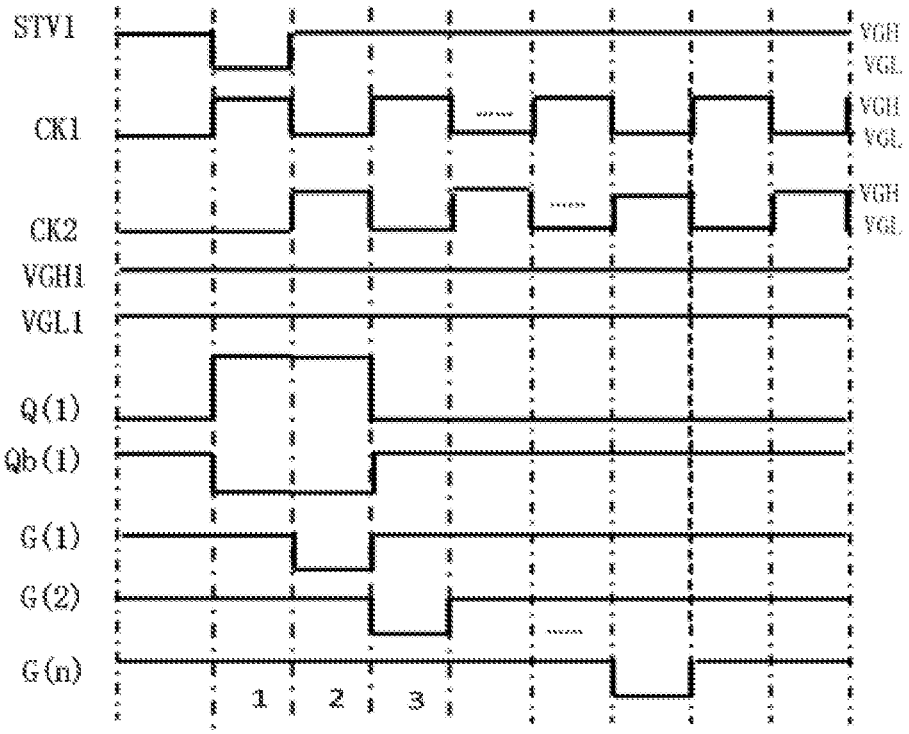
FIG. 4B is a diagram showing a working order of the circuit shown in FIG. 4A.

Please refer to FIGS. 4A and 4B. FIG. 4A is a diagram of a GOA circuit according to an embodiment of the present invention. FIG. 4B is a diagram showing a working order of the circuit shown in FIG. 4A.

The GOA circuit comprises a plurality of GOA units connected in series. The GOA unit adopts the above-mentioned GOA unit. As shown in FIG. 4A, in this embodiment, n+1 GOA units connected in series are taken as an example (n is an integer larger than 1). In this embodiment, except for the first GOA unit, in two adjacent GOA units, the control signal end Cout(n−1) of a succeeding GOA unit GOA(n) is coupled to the second output end Cout(n−1) of a previous GOA unit GOA(n−1), and the control signal end STV of the first GOA unit GOA(1) is coupled to a control signal source STV1. That is, the first GOA unit GOA(1) should receive a starting signal from the control signal source STV1. The other GOA units receive the signal from the second output end Cout(n) of a previous GOA unit. In all the GOA units, the clock signal end CK of each of odd GOA units is coupled to a first clock signal source CK1, and the clock signal end CK of each of even GOA units is coupled to a second clock signal source CK2. The signal of the first clock signal source CK1 and the signal of the second clock signal CK2 have opposite phases.

The first voltage end VGH of each of all the GOA units is coupled to the first voltage source VGH1 and the second voltage end VGL of each of all the GOA units is coupled to a second voltage source VGL1.

In the following disclosure, the operation of the GOA circuit shown in FIG. 4A is divided into three stages according to the working order shown in FIG. 4B.

Stage 1: The clock signal end CK receives a high voltage level. The first transistor T31 is turned on. The control signal source STV1 inputs the low voltage level signal to the first node Qb through the first transistor T31. The second transistor T32, the third transistor T33, the fourth transistor T34 and the fifth transistor T35 are all turned off. The sixth transistor T36 and the seventh transistor T37 are both turned on. The second node Q is pulled up to a high voltage level by the DC high voltage level signal VGH1 through the seventh transistor T37. The eighth transistor T38, ninth transistor T39 and the tenth transistor T30 are all turned on. The high voltage of the clock signal end CK maintains the high voltage level of the first output end G(n) and the second output end Cout(n).

Stage 2: The voltage level of the clock signal end CK transit from the high voltage level to the low voltage level. The first transistor T31 is turned off. Because the second node Q maintains the high voltage level. The eighth transistor T38, ninth transistor T39 and the tenth transistor T30 remain on. The first node Qb remains the low voltage level due to the DC low voltage level signal VGL1 through the eighth transistor T38. The low voltage of the clock signal end CK is outputted to the first output end G(n) and the second output end Cout(n) through the ninth transistor T39 and the tenth transistor T30 such that the first output end outputs the negative impulse waveform.

Stage 3: The voltage level of the clock signal end CK transit from the low voltage level to the high voltage level. The first transistor T31 is turned on. The first node Qb is pulled up to the high voltage level by the high voltage level signal outputted from the second output end Cout(n−1) from a previous GOA unit. The second transistor T32, the third transistor T33, the fourth transistor T34 and the fifth transistor T35 are all turned on. The second node Q is pulled down to the low voltage level by the DC low voltage level signal VGL1. The first output end G(n) and the second output end Cout(n) are pulled up to the high voltage level by the DC high voltage level signal. Then, the first transistor T31 remains on the due to the high voltage level of the clock signal end CK to maintain the high voltage level of the first node Qb to ensure the GOA unit to continuously output the high voltage level.

Figure 5:
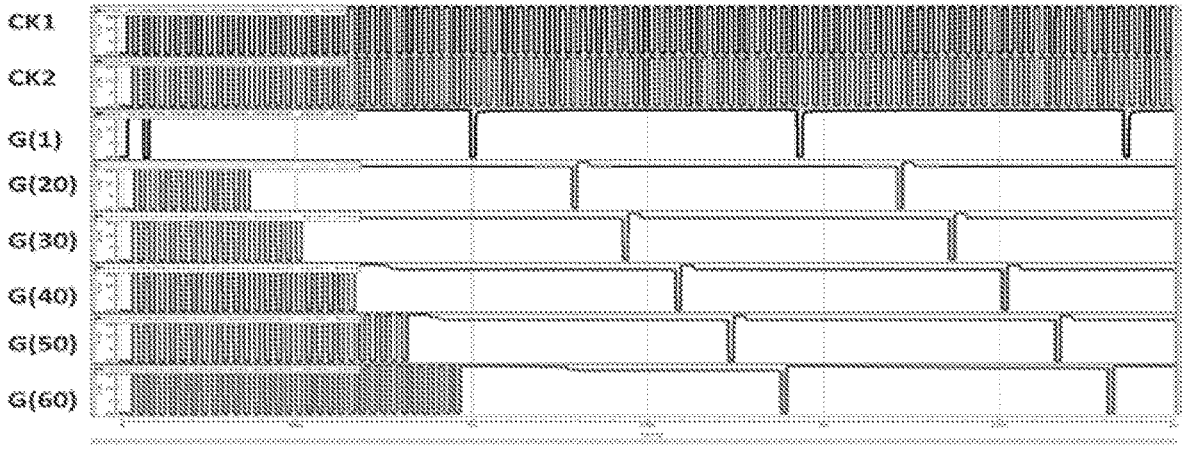
FIG. 5 is a diagram showing simulated waveforms of signals in the circuit shown in FIG. 4A.

Please refer to FIG. 5, which is a diagram of simulated waveforms of signals in the circuit shown in FIG. 4A. FIG. 5 depicts a three-frame simulated waveforms in a GOA units of 61 stages. From FIG. 5, it could be seen that each of the GOA units could normally outputs a negative impulse waveform after the first frame.

Further, a display panel is provided according to an embodiment of the present invention. The display panel comprises the above-mentioned GAO circuit and thus has the same structure and advantages. Since the GOA circuit had been illustrated in the above, further illustrations of the display panel are omitted here.

In an embodiment, the display panel at least comprises Micro-LED display panel, OLED display panel or AMO-LED display penal. For example, the above-mentioned display panel could be implemented in a LCD display, LCDTV, digital picture frame, cell phone, a tablet or any other products and devices having display functions. Thus, the above disclosure could be implemented and used in the display industry.

Above are embodiments of the present invention, which does not limit the scope of the present invention. Any modifications, equivalent replacements or improvements within the spirit and principles of the embodiment described above should be covered by the protected scope of the invention.

What is claimed is:

1. A gate on array (GOA) circuit, comprising:

a plurality of GOA units connected in series, wherein the GOA unit comprises:

a pull-up module, coupled to a clock signal end, a control signal end, and a first node, configured to output the signal of the control signal end to the first node under a control of a first voltage level of the clock signal end;

a pull-up holding module, coupled to a first voltage end, a first output end, a second output end, and the first node, configured to output a signal of the first voltage end to the first output end and the second output end under a control of the first node;

a converting module, coupled to a second voltage end, a second node, the first voltage end and the first node, configured to output a signal of the second voltage end or a signal of the first voltage end to the second node;

a pull-down holding module, coupled to the second voltage end, the second node, and the first node, configured to output the signal of the second voltage end to the first node under a control of the second node; and a pull-down module, coupled to the clock signal end, the second node, the first output end and the second output end, configured to output a second voltage level of the clock signal end to the first output end and the second output end.

2. The GOA circuit of claim 1, wherein the pull-up module comprises a first transistor, a gate of the first transistor is coupled to the clock signal end, a first end of the first transistor is coupled to the control signal end, and a second end of the first transistor is coupled to the first node.

3. The GOA circuit of claim 1, wherein the pull-up holding module comprises:

a second transistor, a gate of the second transistor is coupled to the first node, a first end of the second transistor is coupled to the first output end, and a second end of the second transistor is coupled to the first voltage end; and a third transistor, a gate of the third transistor is coupled to the first node, a first end of the third transistor is coupled to the second output end, and a second end of the third transistor is coupled to the first voltage end.

4. The GOA circuit of claim 1, wherein the converting module comprises:

a fourth transistor, a gate of the fourth transistor is coupled to the first node, and a first end of the fourth transistor is coupled to the second voltage end;

a fifth transistor, a gate of the fifth transistor is coupled to the first node, a first end of the fifth transistor is coupled to the second voltage end, and a second end of the fifth transistor is coupled to the second node;

a sixth transistor, a gate and a second end of the second transistor are coupled to the first voltage end; and a seventh transistor, a gate of the seventh transistor is coupled to the second end of the fourth transistor, and a second end of the seventh transistor is coupled to the first voltage end.

5. The GOA circuit of claim 1, wherein the pull-down holding module comprises:

an eighth transistor, a gate of the eighth transistor is coupled to the second note, a first end of the eighth transistor is coupled to the second voltage end, and a second end of the eighth transistor is coupled to the first node.

6. The GOA circuit of claim 1, wherein the pull-down module comprises:

a ninth transistor, a gate of the ninth transistor is coupled to the second node, a first end of the ninth transistor is coupled to the clock signal end, and a second end of the ninth transistor is coupled to the first output end; and a tenth transistor, a gate of the tenth transistor is coupled to the second node, a first end of the tenth transistor is coupled to the clock signal end, and a second end of the tenth transistor is coupled to the second output end.

7. A gate on array (GOA) circuit, comprising:

a plurality of GOA units connected in series, wherein the GOA unit comprises:

a pull-up module, coupled to a clock signal end, a control signal end, and a first node, configured to output the signal of the control signal end to the first node under a control of a first voltage level of the clock signal end;

a pull-up holding module, coupled to a first voltage end, a first output end, a second output end, and the first node, configured to output a signal of the first voltage end to the first output end and the second output end under a control of the first node;

a converting module, coupled to a second voltage end, a second node, the first voltage end and the first node, configured to output a signal of the second voltage end or a signal of the first voltage end to the second node;

a pull-down holding module, coupled to the second voltage end, the second node, and the first node, configured to output the signal of the second voltage end to the first node under a control of the second node; and a pull-down module, coupled to the clock signal end, the second node, the first output end and the second output end, configured to output a second voltage level of the clock signal end to the first output end and the second output end;

wherein except for a first GOA unit, in two adjacent GOA units, the control signal end of a succeeding GOA unit is coupled to the second output end of a previous GOA unit, and the control signal end of the first GOA unit is coupled to a control signal source;

wherein in all the GOA units, the clock signal end of each of odd GOA units is coupled to a first clock signal source, the clock signal end of each of even GOA units is coupled to a second clock signal source, and a signal of the first clock signal source and a signal of the second clock signal have opposite phases; and wherein the first voltage end of each of all the GOA units is coupled to a first voltage source and the second voltage end of each of all the GOA units is coupled to a second voltage source.

8. The GOA circuit of claim 7, wherein the pull-up module comprises a first transistor, a gate of the first transistor is coupled to the clock signal end, a first end of the first transistor is coupled to the control signal end, and a second end of the first transistor is coupled to the first node.

9. The GOA circuit of claim 7, wherein the pull-up holding module comprises:

a second transistor, a gate of the second transistor is coupled to the first node, a first end of the second transistor is coupled to the first output end, and a second end of the second transistor is coupled to the first voltage end; and a third transistor, a gate of the third transistor is coupled to the first node, a first end of the third transistor is coupled to the second output end, and a second end of the third transistor is coupled to the first voltage end.

10. The GOA circuit of claim 7, wherein the converting module comprises:

a fourth transistor, a gate of the fourth transistor is coupled to the first node, and a first end of the fourth transistor is coupled to the second voltage end;

a fifth transistor, a gate of the fifth transistor is coupled to the first node, a first end of the fifth transistor is coupled to the second voltage end, and a second end of the fifth transistor is coupled to the second node;

a sixth transistor, a gate and a second end of the second transistor are coupled to the first voltage end; and a seventh transistor, a gate of the seventh transistor is coupled to the second end of the fourth transistor, and a second end of the seventh transistor is coupled to the first voltage end.

11. The GOA circuit of claim 7, wherein the pull-down holding module comprises:

an eighth transistor, a gate of the eighth transistor is coupled to the second note, a first end of the eighth transistor is coupled to the second voltage end, and a second end of the eighth transistor is coupled to the first node.

12. The GOA circuit of claim 7, wherein the pull-down module comprises:

a ninth transistor, a gate of the ninth transistor is coupled to the second node, a first end of the ninth transistor is coupled to the clock signal end, and a second end of the ninth transistor is coupled to the first output end; and a tenth transistor, a gate of the tenth transistor is coupled to the second node, a first end of the tenth transistor is coupled to the clock signal end, and a second end of the tenth transistor is coupled to the second output end.

13. The GOA circuit of claim 7, wherein the GOA unit is implemented with N-type thin film transistor.

14. A display panel, comprising a gate on array (GOA) circuit, the GOA circuit comprising:

a plurality of GOA units connected in series, wherein the GOA unit comprises:

a pull-up module, coupled to a clock signal end, a control signal end, and a first node, configured to output the signal of the control signal end to the first node under a control of a first voltage level of the clock signal end;

a pull-up holding module, coupled to a first voltage end, a first output end, a second output end, and the first node, configured to output a signal of the first voltage end to the first output end and the second output end under a control of the first node;

a converting module, coupled to a second voltage end, a second node, the first voltage end and the first node, configured to output a signal of the second voltage end or a signal of the first voltage end to the second node;

a pull-down holding module, coupled to the second voltage end, the second node, and the first node, configured to output the signal of the second voltage end to the first node under a control of the second node; and a pull-down module, coupled to the clock signal end, the second node, the first output end and the second output end, configured to output a second voltage level of the clock signal end to the first output end and the second output end;

wherein except for a first GOA unit, in two adjacent GOA units, the control signal end of a succeeding GOA unit is coupled to the second output end of a previous GOA unit, and the control signal end of the first GOA unit is coupled to a control signal source;

wherein in all the GOA units, the clock signal end of each of odd GOA units is coupled to a first clock signal source, the clock signal end of each of even GOA units is coupled to a second clock signal source, and a signal of the first clock signal source and a signal of the second clock signal have opposite phases; and wherein the first voltage end of each of all the GOA units is coupled to a first voltage source and the second voltage end of each of all the GOA units is coupled to a second voltage source.

15. The display panel of claim 14, wherein the pull-up module comprises a first transistor, a gate of the first transistor is coupled to the clock signal end, a first end of the first transistor is coupled to the control signal end, and a second end of the first transistor is coupled to the first node.

16. The display panel of claim 14, wherein the pull-up holding module comprises:

a second transistor, a gate of the second transistor is coupled to the first node, a first end of the second transistor is coupled to the first output end, and a second end of the second transistor is coupled to the first voltage end; and a third transistor, a gate of the third transistor is coupled to the first node, a first end of the third transistor is coupled to the second output end, and a second end of the third transistor is coupled to the first voltage end.

17. The display panel of claim 14, wherein the converting module comprises:

a fourth transistor, a gate of the fourth transistor is coupled to the first node, and a first end of the fourth transistor is coupled to the second voltage end;

a fifth transistor, a gate of the fifth transistor is coupled to the first node, a first end of the fifth transistor is coupled to the second voltage end, and a second end of the fifth transistor is coupled to the second node;

a sixth transistor, a gate and a second end of the second transistor are coupled to the first voltage end; and a seventh transistor, a gate of the seventh transistor is coupled to the second end of the fourth transistor, and a second end of the seventh transistor is coupled to the first voltage end.

18. The display panel of claim 14, wherein the pull-down holding module comprises:

an eighth transistor, a gate of the eighth transistor is coupled to the second note, a first end of the eighth transistor is coupled to the second voltage end, and a second end of the eighth transistor is coupled to the first node.

19. The display panel of claim 14, wherein the pull-down module comprises:

a ninth transistor, a gate of the ninth transistor is coupled to the second node, a first end of the ninth transistor is coupled to the clock signal end, and a second end of the ninth transistor is coupled to the first output end; and a tenth transistor, a gate of the tenth transistor is coupled to the second node, a first end of the tenth transistor is coupled to the clock signal end, and a second end of the tenth transistor is coupled to the second output end.

20. The display panel of claim 14, wherein the GOA unit is implemented with N-type thin film transistor.

* * * * *